US011643895B2

(12) United States Patent
Zeng et al.

(10) Patent No.: US 11,643,895 B2
(45) Date of Patent: May 9, 2023

(54) SEALED PRESSURED HORIZONTAL DIRECTIONAL DRILLING CONTINUOUS CORING DEVICE FOR ENGINEERING GEOLOGICAL INVESTIGATION

(71) Applicant: China University of Geosciences (Wuhan), Hubei (CN)

(72) Inventors: Cong Zeng, Hubei (CN); Xuefeng Yan, Hubei (CN); Peng Zhang, Hubei (CN)

(73) Assignee: China University of Geosciences (Wuhan), Hubei (CN)

( * ) Notice: Subject to any disclaimer, the term of this patent is extended or adjusted under 35 U.S.C. 154(b) by 0 days.

(21) Appl. No.: 17/513,855

(22) Filed: Oct. 28, 2021

(65) Prior Publication Data

US 2022/0049564 A1 Feb. 17, 2022

(30) Foreign Application Priority Data

Oct. 30, 2020 (CN) ..... 202011193004.8

(51) Int. Cl.

| | |
|---|---|
| ***E21B 25/10*** | (2006.01) |
| ***E21B 7/04*** | (2006.01) |
| ***E21B 23/08*** | (2006.01) |
| ***E21B 25/02*** | (2006.01) |

(52) U.S. Cl.

CPC ..... *E21B 25/10* (2013.01); *E21B 7/046* (2013.01); *E21B 23/08* (2013.01); *E21B 25/02* (2013.01)

(58) Field of Classification Search

CPC ..... E21B 25/10; E21B 7/046; E21B 23/08; E21B 25/02; E21B 25/16

See application file for complete search history.

(56) References Cited

U.S. PATENT DOCUMENTS

| | | | | |
|---|---|---|---|---|
| 2,258,352 | A * | 10/1941 | Catland | E21B 25/02 175/254 |
| 3,951,219 | A * | 4/1976 | Cortes | E21B 25/02 175/246 |
| 7,117,958 | B2 * | 10/2006 | Fanuel | E21B 23/06 166/117.6 |
| 2022/0042376 | A1 * | 2/2022 | Zeng | E21B 7/046 |
| 2022/0098948 | A1 * | 3/2022 | Li | E21B 34/14 |

* cited by examiner

*Primary Examiner* — Jonathan Malikasim

(57) ABSTRACT

A sealed pressured horizontal directional drilling continuous coring device for engineering geological investigation includes an outer tube assembly and an inner tube assembly matching the outer tube assembly. The outer tube assembly includes a single-wall drill pipe and a dual-wall drill pipe assembly. The inner wall of the dual-wall drill pipe assembly is sequentially provided with a bullet stop head, a bullet room, a suspended seat ring, a positioning inner lock, a positioning outer lock, a first centralizing ring, a lock ring seat and a drill from top to bottom. The inner tube assembly includes a spear head, a first sealing component, a bullet positioning mechanism, a recovery pipe, a second sealing component, an in-place reporting mechanism, a core blockage alarm mechanism, a single-action mechanism, a guiding mechanism, a buffer mechanism, an adjustment mechanism, a core tube and a core clamping mechanism.

10 Claims, 4 Drawing Sheets

II-II

SEALED PRESSURED HORIZONTAL DIRECTIONAL DRILLING CONTINUOUS CORING DEVICE FOR ENGINEERING GEOLOGICAL INVESTIGATION

CROSS REFERENCE OF RELATED APPLICATION

The present invention claims priority under 35 U.S.C. 119(a-d) to CN 202011193004.8, filed Oct. 30, 2020.

BACKGROUND OF THE PRESENT INVENTION

Field of Invention

The present invention provides a sealed pressured horizontal directional drilling continuous coring device for engineering geological investigation, which belongs to the field of engineering geological investigation.

Description of Related Arts

Wire-line core drilling is an advanced core drilling technology. It uses a large-diameter drill pipe and a core tube which is set in the drill tool. During the drilling process, the core is slowly installed in the core tube. While being full of the core, the core tube is lifted out of the drill pipe by a fisher with a rope. After the core is extracted, the core tube is put through the drill pipe to the bottom of the hole for continuing to drill. Compared with the ordinary core drilling technology, the wire-line core drilling has advantages of good drill hole deflection control, high drilling efficiency, low engineering cost, high core extraction rate, and fewer accidents in the drill hole; especially in drilling through complex formations, it has incomparable advantages over other construction technologies. Therefore, it is widely used in the field of engineering geological investigation and resource exploration. The feature of its operation is that when taking the core, it is not necessary to lift all the drill pipe strings in the borehole, Instead, a special fishing device with a wire rope is used to lift the inner tube at the bottom of the hole with the core to the ground through the center hole of the drill pipe in the hole, the core is obtained, thereby reducing the number of lifting and lowering drilling times and the auxiliary time of lifting the drilling tool, thereby improving the drilling efficiency.

At present, the rope core drilling technology is mainly used in the traditional vertical drilling investigation method, which mainly adopts the core drilling and guided separation mode of "lower core tube-coring-trajectory measurement-directional control rectification-lower core tube". However, with the increase of long and large tunnel projects, the traditional vertical drilling investigation method is facing great challenges, its implementation is very difficult, and the obtained stratigraphic information is unable to meet the needs of engineering design, and the horizontal directional drilling engineering geological investigation technology is able to solve the shortcomings of the vertical drilling investigation method, but it is unable to take the core, so it is unable to be applied to the geological survey work.

SUMMARY OF THE PRESENT INVENTION

In order to solve the deficiencies in the prior art, the present invention provides a sealed pressured horizontal directional drilling continuous coring device for engineering geological investigation. The device combines guiding and coring, which is able to accurately control direction and efficiently coring.

The technical schemes adopted by the present invention to solve its technical problems are:

A sealed pressured horizontal directional drilling continuous coring device for engineering geological investigation comprises an outer tube assembly and an inner tube assembly matching the outer tube assembly, wherein:

the outer tube assembly comprises a single-wall drill pipe and a dual-wall drill pipe assembly, wherein the single-wall drill pipe is located on an upper part of the dual-wall drill pipe assembly, an inner wall of the dual-wall drill pipe assembly is sequentially provided with a bullet stop head, a bullet room, a suspended seat ring, a positioning inner lock of probe room, a positioning outer lock of probe room, a first centralizing ring, a lock ring seat and a drill from top to bottom;

the inner tube assembly, which is located inside the single-wall drill pipe and the dual-wall drill pipe assembly, comprises a spear head, a first sealing component, a bullet positioning mechanism, a recovery pipe, a second sealing component, an in-place reporting mechanism, a core blockage alarm mechanism, a single-action mechanism, a guiding mechanism, a buffer mechanism, an adjustment mechanism, a core tube and a core clamping mechanism;

the dual-wall drill pipe assembly comprises a first dual-wall drill pipe, a second dual-wall drill pipe, and a third dual-wall drill pipe from top to bottom, wherein the second dual-wall drill pipe is a non-magnetic dual-wall drill pipe, and is located at a position corresponding to the guiding mechanism.

Further improvements to the above scheme are:

The bullet positioning mechanism, which is located in the bullet room under the bullet stop head, comprises a first spring pin, a spring, a bullet, a first bullet pin and a second bullet pin.

The in-place reporting mechanism comprises a suspension ring located above the suspended seat ring, a valve body is provided in a center of the suspension ring, a valve plug is provided under the valve body, a second water port and a third water port are provided on the inner wall of the dual-wall drill pipe assembly corresponding to the valve plug.

The core blockage alarm mechanism comprises a second spring pin, a sliding sleeve, a sealing ring and a disc spring.

The guiding mechanism comprises a probe room and a probe located in the probe room, a first centralizing ring is arranged between the probe room and the second dual-wall drill pipe, and the positioning inner lock and a main body of the single-action mechanism are connected by a bearing.

The positioning inner lock of probe room, the positioning outer lock of probe room, the probe room and the first centralizing ring are all made of non-magnetic materials.

The core clamping mechanism comprises a lock ring and a lock ring seat.

The first water port, the second water port and the third water port are provided at an inner wall of the first dual-wall drill pipe.

The second centralizing ring is provided between the core tube and the second dual-wall drill pipe.

The first sealing component comprises two first sealing splints and a first sealing gasket, wherein the first sealing gasket is located between the two first sealing splints; the second sealing component comprises a second sealing splint and a second gasket under the second sealing splint.

According to the technical scheme of the present invention, the sealed pressured horizontal directional drilling continuous coring device for engineering geological investigation adopts the sealing device pressure-feeding method to place the core tube, which greatly improves the efficiency of pipe-taking and down-pipe. The position of the inner tube assembly relative to the drill pipe is accurately positioned by the bullet positioning mechanism and the in-place reporting mechanism. The core blockage alarm mechanism is able to generate upward thrust when the core is clogged or the core is filled with the core tube, so that the sliding sleeve moves upward against the force of the disc spring, thereby blocking the water ports, causing the pressure of the pump pressure to rise, then playing the role of blockage alarm. The single-action mechanism is able to ensure that the probe room and the core tube below the probe room will not rotate with the drill pipe. The probe in the probe room is able to send electronic signals, so that the drilling is able to be accurately guided. The cooperation of the positioning inner lock of probe room and the positioning outer lock of probe room is able to ensure that the position of the probe room and the second dual-wall drill pipe are relatively fixed to ensure accurate guidance. The positioning inner lock of probe room, the positioning outer lock of probe room, the probe room and centralizing rings and the second dual-wall drill pipe are all made of non-magnetic materials to avoid affecting the accuracy of probe measurement. The adjustment mechanism is able to adjust the length of the inner tube assembly to meet the matching requirements with the outer tube assembly. It adopts the combination of the first sealing component and the second sealing component to ensure the seal between the inner tube assembly and the drill pipe, so that the principle of mud pumping is able to be used to carry out the pressure delivery of the inner tube assembly.

Figure 1:
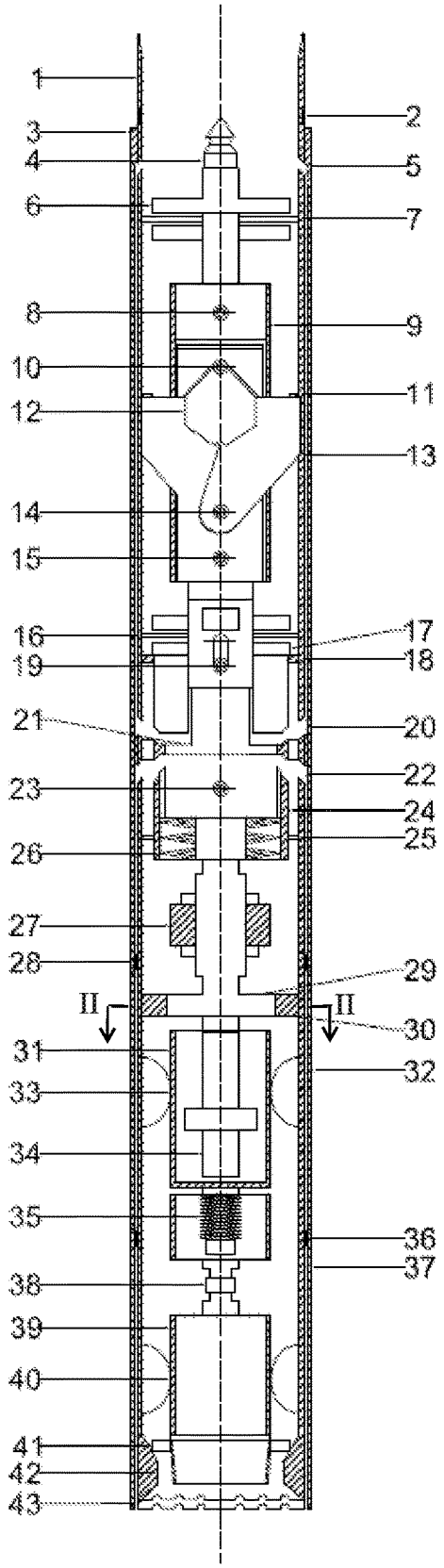
FIG. 1 is an overall structure diagram of the coring device according to the embodiment of the present invention.

In the drawing, 1: single-wall drill pipe; 2: first joint; 3: first dual-wall drill pipe; 4: spear head; 5: first water port; 6: first sealing splint; 7: first sealing gasket; 8: first spring pin; 9: recovery pipe; 10: spring; 11: bullet stop head; 12: bullet; 13: bullet room; 14: first bullet pin; 15: second bullet pin; 16: second sealing gasket; 17: suspension ring; 18: suspended seat ring; 19: valve body; 20: second water port; 21: valve plug; 22: third water port; 23: second spring pin; 24: sliding sleeve; 25: sealing ring; 26: disc spring; 27: single-action mechanism; 28: second joint; 29: positioning inner lock; 30: positioning outer lock; 31: probe room; 32: second dual-wall drill pipe; 33: first centralizing ring; 34: probe rod; 35: buffer mechanism; 36: third joint; 37: third dual-wall drill pipe; 38: adjustment mechanism; 39: core tube; 40: second centralizing ring; 41: lock ring; 42: lock ring seat; 43: drill.

DETAILED DESCRIPTION OF THE PREFERRED EMBODIMENT

The present invention will be further explained below in conjunction with the drawings and embodiments.

Figure 2:
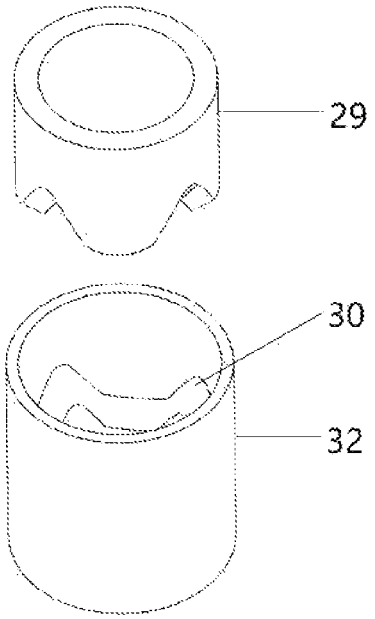
FIG. 2 is a sectional view along II-II in FIG. 1.
Figure 3:
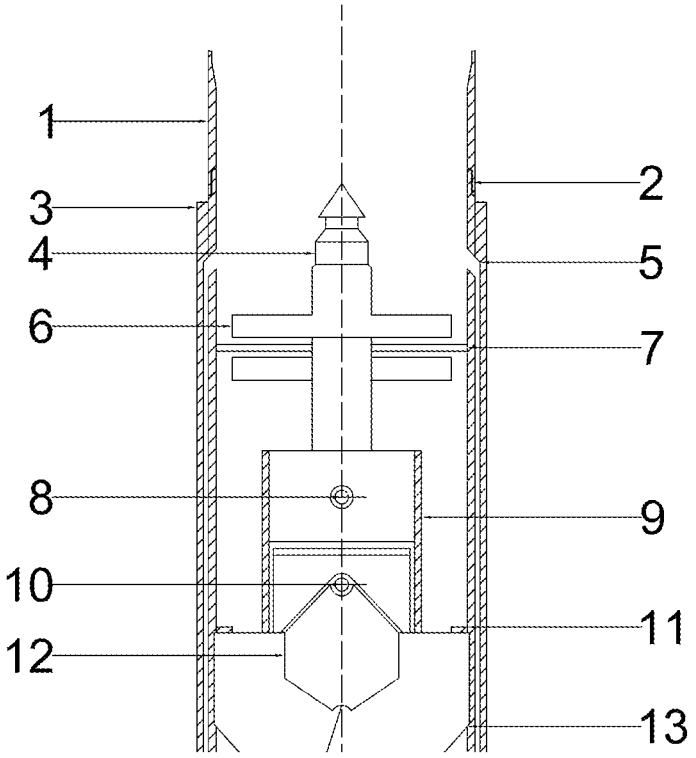
FIGS. 3 to 6 are partially enlarged views of FIG. 1 from top to bottom in sequence.
Figure 4:
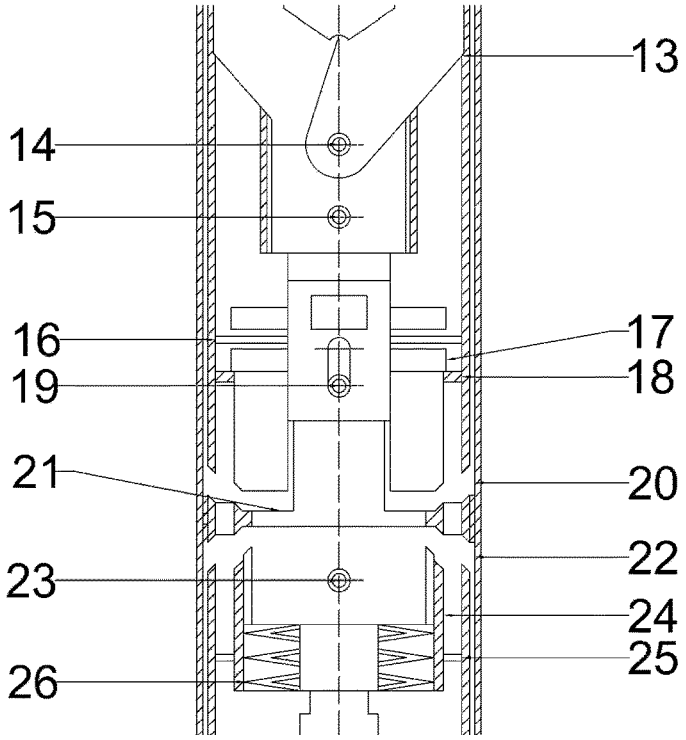
Figure 5:
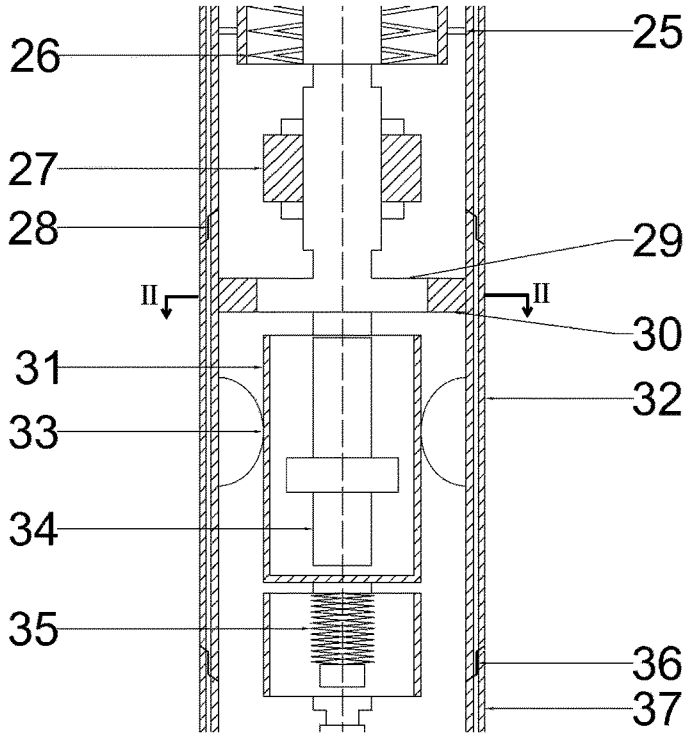
Figure 6:
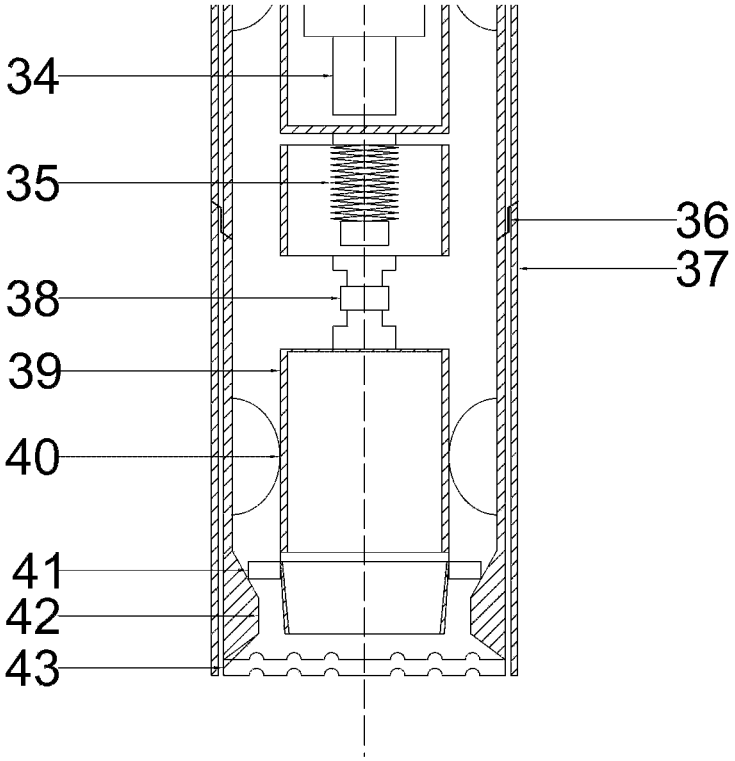

As shown in FIGS. 1 and 2, a sealed pressured horizontal directional drilling continuous coring device for engineering geological investigation according to a preferred embodiment of the present invention is illustrated, wherein the continuous coring device comprises an outer tube assembly and an inner tube assembly matching the outer tube assembly. The outer tube assembly comprises a single-wall drill pipe 1, and a dual-wall drill pipe assembly, wherein the single-wall drill pipe 1 is located on an upper part of the dual-wall drill pipe assembly, an inner wall of the dual-wall drill pipe assembly is sequentially provided with a bullet stop head 11, a bullet room 13, a suspended seat ring 18, a positioning inner lock 29 of probe room, a positioning outer lock 30 of probe room, a first centralizing ring 33, a lock ring seat 42 and a drill 43 from top to bottom.

The inner tube assembly, which is located inside the single-wall drill pipe and the dual-wall drill pipe assembly, comprises a spear head 4, a first sealing component, a bullet positioning mechanism, a recovery pipe 9, a second sealing component, an in-place reporting mechanism, a core blockage alarm mechanism, a single-action mechanism 27, a guiding mechanism, a buffer mechanism 35, an adjustment mechanism 38, a core tube 39 and a core clamping mechanism.

The dual-wall drill pipe assembly comprises a first dual-wall drill pipe 3, a second dual-wall drill pipe 32, and a third dual-wall drill pipe 37 from top to bottom, wherein the second dual-wall drill pipe 32 is a non-magnetic dual-wall drill pipe, and is located at a position corresponding to the guiding mechanism. The single-wall drill pipe 1, the first dual-wall drill pipe 3, the second dual-wall drill pipe 32 and the third dual-wall drill pipe 37 are threadedly connected with each other in sequence through a first joint 2, a second joint 28 and a third joint 36 respectively. A first water port 5 is provided at an inner wall of the first dual-wall drill pipe 3.

The first sealing component comprises two first sealing splints 6 and a first sealing gasket 7, wherein the first sealing gasket 7 is located between the two first sealing splints 6; the second sealing component comprises a second sealing splint and a second gasket 16 under the second sealing splint.

The bullet positioning mechanism, which is located in the bullet room 13 under the bullet stop head 11, comprises a first spring pin 8, a spring 10, a bullet 12, a first bullet pin 14 and a second bullet pin 15.

The in-place reporting mechanism comprises a suspension ring 17 located above the suspended seat ring 18, a valve body 19 is provided in a center of the suspension ring 17, a valve plug 21 is provided under the valve body 19, a second water port 20 and a third water port 22 are provided at the inner wall of the dual-wall drill pipe assembly corresponding to the valve plug 21.

The core blockage alarm mechanism comprises a second spring pin 23, a sliding sleeve 24, a sealing ring 25 and a disc spring 26.

The guiding mechanism comprises a probe room 31 and a probe 34 located in the probe room 31, a first centralizing ring 33 is arranged between the probe room 31 and the second dual-wall drill pipe 32, and the positioning inner lock 29 of probe room and a main body of the single-action mechanism are connected by a bearing to ensure that the probe room 31 does not follow the rotation of the second dual-wall drill pipe 32.

The positioning inner lock 29 of probe room, the positioning outer lock 30 of probe room, the probe room and the first centralizing ring 33 are all made of non-magnetic materials. The cooperation of the positioning inner lock 29 of probe room and the positioning outer lock 30 of probe room is able to ensure that the position of the probe room 31 and the second dual-wall drill pipe 32.

As shown in FIG. 2, the positioning inner lock 29 of probe room and the positioning outer lock 30 of probe room have a vertical fit structure. Due to the limitation of the picture frame, the reference numbers 29 and 30 in FIG. 1 only show the positions of the positioning inner lock 29 of probe room and the positioning outer lock 30 of probe room.

The core clamping mechanism comprises a lock ring 41 and a lock ring seat 42.

The second centralizing ring 40 is provided between the core tube 39 and the second dual-wall drill pipe 32.

The working process principle of the device is as follows:

(1) connecting the device as a whole with the drill pipe of the horizontal directional drilling rig, using the probe rod 34 and the guiding mechanism to monitor and adjust the direction of the drill 43 in real time, realizing the precise steering control of the horizontal directional drilling, and starting the engineering geological survey of the horizontal directional drilling;

(2) when the core is filled with the core tube 39, moving the core tube 39 up and compressing the disc spring 26 as a whole, which causes the sliding sleeve 24 to move up and block the mud passage, so that the mud pressure rises, and the core blockage alarm mechanism works, indicating that the core tube 39 is filled with cores;

(3) controlling the drill rig to draw the wire rope to pull the rope to drive the spearhead, and salvaging the core device of the inner tube assembly, so that the core device moves in the drill pipe as a whole until the hole is pulled out, and the core is taken out;

(4) installing the rope core drilling tool of the inner tube assembly into the drill pipe as a whole, connecting the drill pipe with the drill rig, pumping mud into the drill pipe through the rig mud pump, and using the mud pressure delivery device to enter the bottom of the drill pipe as a whole; when the device as a whole reaches the bottom of the drill pipe, the mud entering a gap of the dual-wall drill pipe assembly through the first water port 5, then entering the valve plug 21 through the second water port 20, and then entering the gap of the dual-wall drill pipe assembly through the third water port 22 again, wherein the in-place reporting mechanism plays a role; during the whole process, the mud pressure rises first and then drops, and the device is in place to continue core drilling; and (5) repeating the steps (2), (3) and (4) until the end of core drilling.

The invention combines guiding and coring, which is able to accurately control direction and efficiently coring; and innovatively uses sealed pressure-feeding components, and uses the principle of mud pressure-feeding to push the coring device of the inner tube assembly to achieve the continuous coring of the horizontal directional hole rope.

What is claimed is:

1. A sealed pressured horizontal directional drilling continuous coring device for engineering geological investigation, the coring device comprising an outer tube assembly and an inner tube assembly matching the outer tube assembly, wherein: the outer tube assembly comprises a single-wall drill pipe and a dual-wall drill pipe assembly, wherein the single wall drill pipe is located on an upper part of the dual-wall drill pipe assembly, an inner wall of the dual-wall drill pipe assembly is sequentially provided with a bullet stop head, a bullet room, a suspended seat ring, a positioning inner lock, a positioning outer lock, a first centralizing ring, a lock ring seat and a drill from top to bottom;

the inner tube assembly, which is located inside the single-wall drill pipe and a dual-wall drill pipe assembly, comprises a spear head, a first sealing component, a bullet positioning mechanism, a recovery pipe, a second sealing component, an in-place reporting mechanism, a core blockage alarm mechanism, a single-action mechanism, a guiding mechanism, a buffer mechanism, an adjustment mechanism, a core tube and a core clamping mechanism;

the dual-wall drill pipe assembly comprises a first dual-wall drill pipe, a second dual-wall drill pipe, and a third dual-wall drill pipe from top to bottom, wherein the second dual-wall drill pipe is a non-magnetic dual-wall drill pipe, and is located at a position corresponding to the guiding mechanism.

2. The coring device according to claim 1, wherein the bullet positioning mechanism, which is located in the bullet room under the bullet stop head, comprises a first spring pin, a spring, a bullet, a first bullet pin and a second bullet pin.

3. The coring device according to claim 1, wherein the in-place reporting mechanism comprises a suspension ring located above the suspended seat ring, a valve body is provided in a center of the suspension ring, a valve plug is provided under the valve body, a second water port and a third water port are provided on the inner wall of the dual-wall drill pipe assembly corresponding to the valve plug.

4. The coring device according to claim 1, wherein the core blockage alarm mechanism comprises a second spring pin, a sliding sleeve, a sealing ring and a disc spring.

5. The coring device according to claim 1, wherein the guiding mechanism comprises a probe room and a probe located in the probe room, the first centralizing ring is arranged between the probe room and the second dual-wall drill pipe, and the positioning inner lock and a main body of the single-action mechanism are connected by a bearing.

6. The coring device according to claim 1, wherein the positioning inner lock, the positioning outer lock, the probe room and the first centralizing ring are all made of non-magnetic materials.

7. The coring device according to claim 1, wherein the core clamping mechanism comprises a lock ring and a lock ring seat.

8. The coring device according to claim 1, wherein a first water port, a second water port and a third water port are provided at the inner wall of the first dual-wall drill pipe.

9. The coring device according to claim 1, wherein the second centralizing ring is provided between the core tube and the second dual-wall drill pipe.

10. The coring device according to claim 1, wherein the first sealing component comprises two first sealing splints and a first sealing gasket, the first sealing gasket is located between the two first sealing splints; the second sealing component comprises a second sealing splint and a second gasket under the second sealing splint.

* * * * *